US006857895B2

(12) United States Patent
Korte et al.

(10) Patent No.: US 6,857,895 B2
(45) Date of Patent: Feb. 22, 2005

(54) ELECTRICAL CONNECTOR APPARATUS AND METHOD

(75) Inventors: Donald R. Korte, Belleair Beach, FL (US); Rip Hanks, Gulf Breeze, FL (US)

(73) Assignee: Centerpin Technology, Inc., Pensacola, FL (US)

( * ) Notice: Subject to any disclaimer, the term of this patent is extended or adjusted under 35 U.S.C. 154(b) by 8 days.

(21) Appl. No.: 10/198,301

(22) Filed: Jul. 17, 2002

(65) Prior Publication Data

US 2003/0054700 A1 Mar. 20, 2003

Related U.S. Application Data

(60) Provisional application No. 60/306,081, filed on Jul. 17, 2001.

(51) Int. Cl.[7] ..... H01R 11/20
(52) U.S. Cl. ..... 439/428; 439/427
(58) Field of Search ..... 439/427, 428, 439/388, 762

(56) References Cited

U.S. PATENT DOCUMENTS

| | | | | |
|---|---|---|---|---|
| 916,313 A | | 3/1909 | Herrington | |
| 1,856,018 A | | 4/1932 | Barth | |
| 3,156,762 A | * | 11/1964 | Matthysse | 174/87 |
| 3,492,630 A | * | 1/1970 | Gerhard | 439/428 |
| 4,163,597 A | * | 8/1979 | Brenholts | 439/126 |
| 4,561,179 A | | 12/1985 | Brush et al. | |
| 5,221,213 A | | 6/1993 | Lee | |
| 5,310,361 A | | 5/1994 | Muchowicz et al. | |
| 5,318,458 A | | 6/1994 | Thorner | |
| 5,573,433 A | | 11/1996 | Lin et al. | |
| 5,695,369 A | * | 12/1997 | Swenson, Sr. | 439/784 |
| 5,775,934 A | | 7/1998 | McCarthy | |
| 5,899,777 A | | 5/1999 | Liang | |
| 5,934,943 A | * | 8/1999 | McCarthy | 439/695 |
| RE36,700 E | | 5/2000 | McCarthy | |
| 6,062,897 A | | 5/2000 | McCarthy | |
| 6,071,155 A | | 6/2000 | Liang | |

FOREIGN PATENT DOCUMENTS

| | | |
|---|---|---|
| DE | 16/20307 | 2/1951 |
| WO | WO 85/04052 | 9/1985 |

* cited by examiner

*Primary Examiner*—Phuong Dinh
(74) *Attorney, Agent, or Firm*—Daspin & Aument, LLP; Jefferson Perkins

(57) ABSTRACT

The subject invention pertains to a method and an electrical connector for coupling to a multi-stranded conductor. In a specific embodiment, the subject method and electrical connector can be used for coupling to an insulated multi-stranded conductor. In a specific embodiment, the subject connector can have: a housing having at least one bore for receiving an insulated multi-stranded electrical conductor; an electrically conductive prong located in the bore and electrically connected to the housing; and a securing means for insertion into the bore after insertion of the electrical conductor into the bore and onto the prong. Insertion of the securing means into the bore, after insertion of the electrical conductor into the bore and onto the prong, presses the strands of the electrical conductor against the conductive prong such that the connector makes electrical contact with the electrical conductor and acts to mechanically secure the electrical conductor to the connector.

20 Claims, 10 Drawing Sheets

ELECTRICAL CONNECTOR APPARATUS AND METHOD

CROSS-REFERENCE TO RELATED APPLICATION(S)

The present application claims the benefit of U.S. Provisional Application Ser. No. 60/306,081, filed Jul. 17, 2001, which is hereby incorporated by reference herein in its entirety, including any figures, tables, nucleic acid sequences, amino acid sequences, or drawings.

BACKGROUND OF THE INVENTION

The present invention relates to electrical connectors. In specific embodiments the invention pertains to an electrical connector for coupling to an insulated multi-stranded conductor.

Typically, in installing insulated multi-stranded conductors, the end of the wire is stripped of insulation and the bare-stranded wire is inserted into a connector where it is soldered, clamped, or otherwise attached to the connector. It is an object of the present invention to provide an improved electrical connector and method for mechanically coupling and electrically coupling an insulated multi-stranded conductor to an electrical connector without the need for stripping the insulation from the cable.

BRIEF SUMMARY OF THE INVENTION

The subject invention pertains to a method and an electrical connector for coupling to a multi-stranded conductor. In a specific embodiment, the subject method and electrical connector can be used for coupling to an insulated multi-stranded conductor. In a specific embodiment, the subject connector can have: a housing having at least one bore for receiving an insulated multi-stranded electrical conductor; an electrically conductive prong located in the bore and electrically connected to the housing; and a securing means for insertion into the bore after insertion of the electrical conductor into the bore and onto the prong. Insertion of the securing means into the bore, after insertion of the electrical conductor into the bore and onto the prong, presses the strands of the electrical conductor against the conductive prong such that the connector makes electrical contact with the electrical conductor and acts to mechanically secure the electrical conductor to the connector.

In a specific embodiment, an electrical connector is provided for coupling a battery cable to a battery terminal. The subject connector can include a housing having a bore, a conductive prong located within the bore and electrically connected to the housing, and a securing means for securing at least one battery cable to a cable-receiving portion of the connector. The prong is wide at the base and narrows towards the opening of the bore. The housing can also have a battery terminal attaching portion for attaching the connector to a battery terminal. The cable receiving portion can have an electrically conductive prong which can reside within the bore and be in electrical contact with the connector's housing. The prong can penetrate between the strands of a multi-stranded conductor of a battery cable as the battery cable is inserted into the bore and impaled onto the prong. The securing means can be an end cap threaded for mating with threads on the cable-receiving portion of the housing. In a specific embodiment, the threads can be within the bore. The end cap can have an opening through which a battery cable can pass through.

In practice, the end of a battery cable is passed through the opening in the end cap and into the bore in the housing such that the end of the battery cable is pierced by the prong within the bore in the housing. Forcing the multi-stranded center conductor onto the prong causes the end of the cable to expand over the conductive prong, and the outer center conductor insulation of the cable to expand to an outer diameter greater than the inner diameter of the end cap. Once the end of the cable is impaled on the prong, the end cap can be threaded into the bore. As the end cap is threaded into the bore, the distal end of the end cap contacts the insulation on a battery cable such that further threading of the end cap squeezes the strands of the conductor of the battery cable against the prong so as to hold the end of the battery cable in place and make electrical contact between the battery cable and the connector. Preferably, the end cap presses into the outer insulation so as to achieve a watertight seal between the battery cable and the end cap. Optionally, an o-ring can be positioned between the cable receiving portion of the connector and the end cap in order to achieve a water-tight seal between the cable receiving portion and the end cap.

In an additional embodiment, the housing can have a plurality of bores and a corresponding plurality of electrically conductive prongs, one prong within each bore. Accordingly, this connector can receive and make electrical contact with a plurality of insulated multi-stranded electrical conductors. Each conductive prong penetrates a single battery cable upon insertion of the battery cables into the bores. The subject connector can have a securing means for securing the plurality of electrical conductors to the housing such that the conductors make electrical contact with the housing. The securing means can have a large circular cap having a plate with a plurality of tubes spaced and sized to fit into the bores in the housing. Each cable from the plurality of battery cables can be fed through an individual tube from the plurality of tubes of the plate. The end cap can incorporate a means for pressing tubes into the bores by pressing the plate toward the housing. For example, the end cap can then be threaded onto the housing and drive the plate, and plurality of tubes, toward cable-receiving portion, such that each tube of the plate enters a bore and presses the insulation and strands of the conductor against the conductive prong (s). As the plate is further pressed toward the housing, and each tube further pressed into a corresponding bore, each tube acts to secure the electrical conductor in place so as to maintain a mechanical connection between the conductor and the housing and an electrical connection between the conductor and the prong. Since the prong is in electrical contact with the housing, electrical contact is maintained between the conductor and the housing. Each tube can contact the outer insulation of the corresponding multi-stranded cable to provide a water-tight seal.

In a specific embodiment of the subject invention, a bolt can be used to tighten the housing onto, for example, a battery terminal. The bolt can have external threads for threading into the housing. The bolt can, for example, squeeze a battery terminal attaching portion of the housing together so as to clamp onto a battery terminal. In a specific embodiment, the bolt can have a threaded bore into the top of the bolt. A second bolt can be threaded into the threaded bore in the top of the first bolt. In practice, the first bolt is threaded into a threaded hole in the housing portion in order to cause the battery terminal attaching portion to clamp onto a battery terminal. After the first bolt has been tightened such that the connector is connected to a battery terminal, the second bolt can be threaded and tightened into the bore of the first bolt. Other cables and conductors can be attached to the connector via the second bolt. For example, a ring terminal can be positioned between the first and second bolts so as to be in electrical contact with the connector. In this way, a ring terminal, or other type of terminal(s) can make a mechanical and electrical connection to the housing of the connector. This connection can be made without loosening the first bolt so that the connector can stay in secured attachment with the battery terminal during the attachment of the additional conductors.

In a specific embodiment, the subject connector can be used as a splice connector for coupling a first multi-stranded cable to a second multi-stranded cable. The subject splice connector can include for each cable being coupled, a housing having a bore, a conductive prong located within the bore and electrically connected to the housing, and a securing means for securing at least one battery cable to the connector. The prong can be wide at the base and narrow towards the opening of the bore. Both cable receiving portions can have an electrically conductive prong which can reside within the bore and be in electrical contact with the connector's housing. The prong can penetrate between the strands of a multi-stranded conductor of a battery cable as the battery cable is inserted into the bore and impaled onto the prong. The securing means can be an end cap threaded for mating with threads on each cable-receiving portion of the housing. In a specific embodiment, the threads can be within the bore. The end cap can have an opening through which a battery cable can pass through.

BRIEF DESCRIPTION OF THE DRAWINGS

FIG. 13A is a sectional view of a connector in accordance with the present invention.

DETAILED DESCRIPTION OF THE INVENTION

Figure 1:
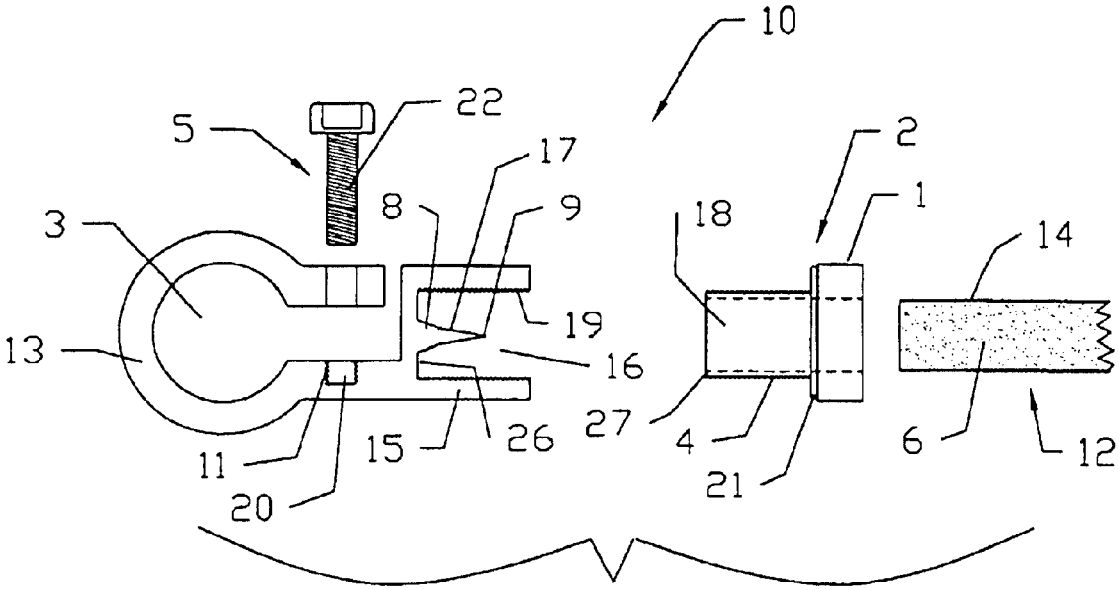
FIG. 1 is a sectional view of a connector in accordance with the present invention
Figure 4:
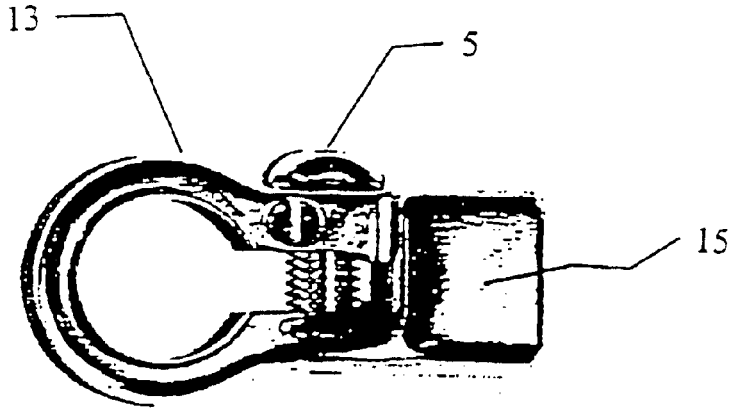
FIG. 4 shows a connector in accordance with the present invention.
Figure 2B:
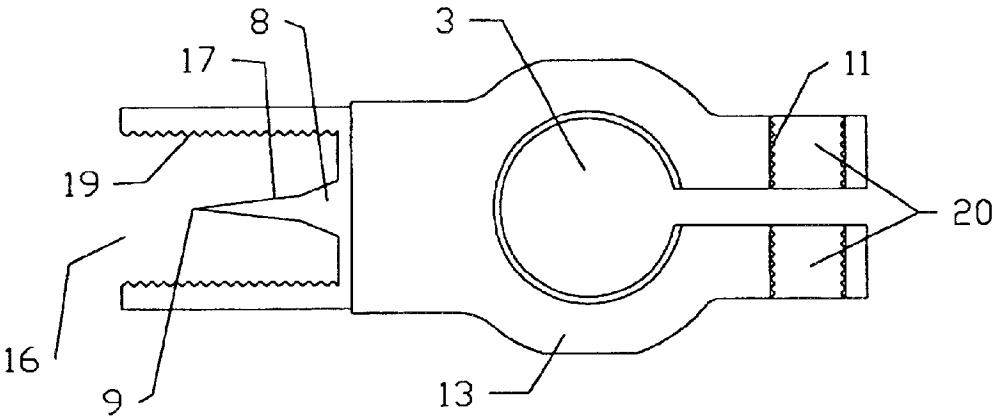
FIGS. 2A and 2B show side views of a cable attaching portion of a connector and a connector in accordance with the present invention.
Figure 2A:
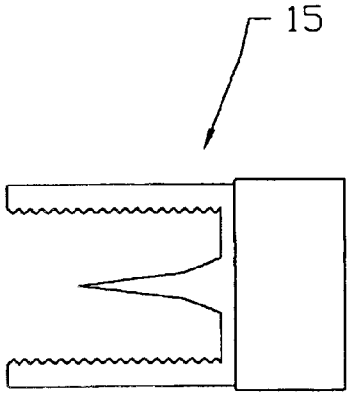
Figure 2D:
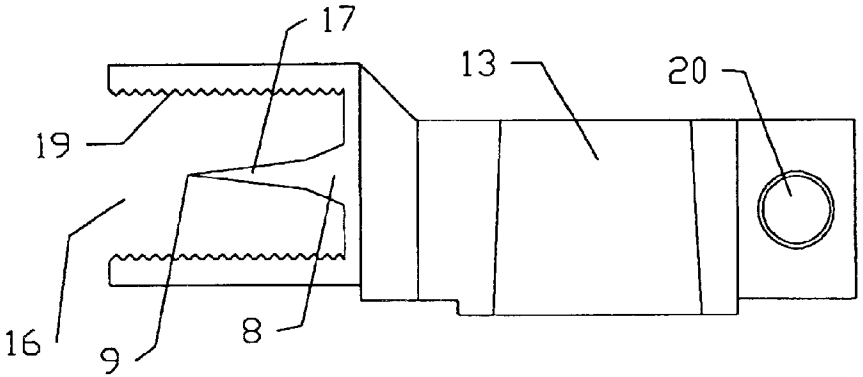
FIGS. 2C and 2D show and end and side view, respectively, of a connector in accordance with the present invention.
Figure 2C:
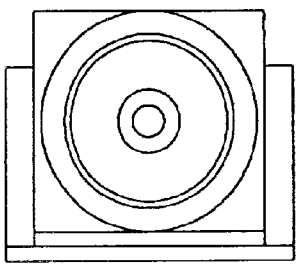
Figure 3B:
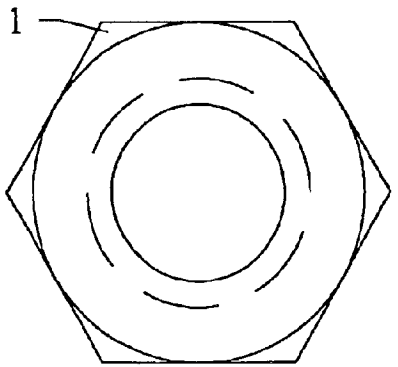
FIGS. 3A and 3B show a side and end view, respectively, of an end cap in accordance with the present invention.
Figure 3D:
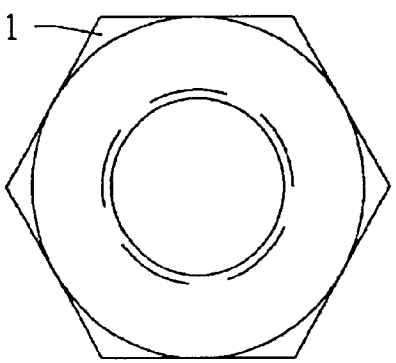
FIGS. 3C and 3D show a side and end view, respectively, of an end cap in accordance with the present invention.
Figure 3A:
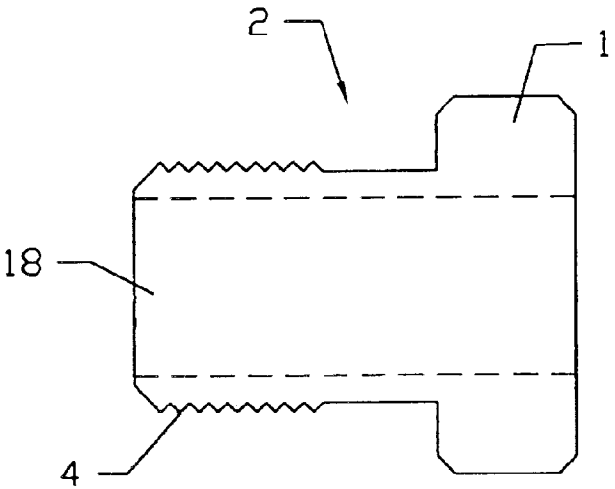
Figure 3C:
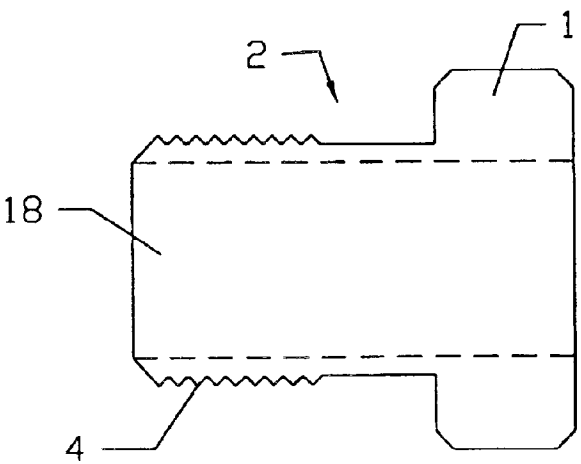
Figure 5A:
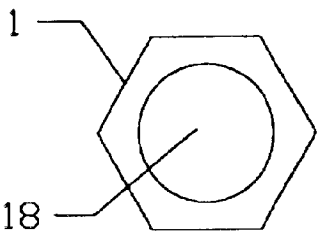
FIGS. 5A and 5B show an end view and a side, respectively, of an end cap in accordance with the subject invention.
Figure 5B:
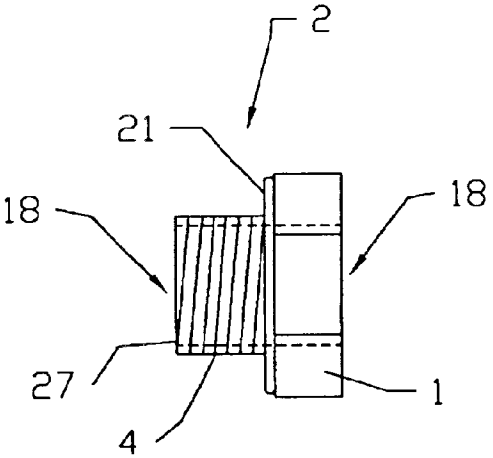
Figure 6:
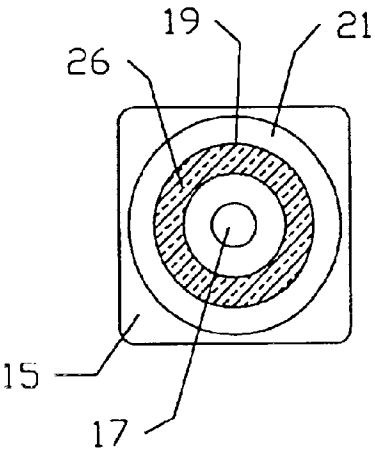
FIG. 6 shows an end view of a cable-receiving portion of a connector in accordance with the present invention.
Figure 7:
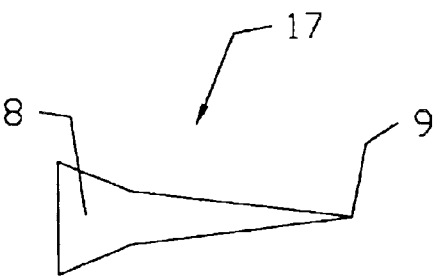
FIG. 7 shows a side view of a prong which can be incorporated with a connector in accordance with the present invention.
Figure 9B:
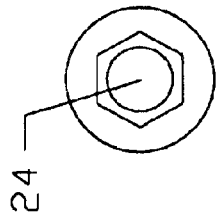
FIGS. 9A and 9B show a side view and end view, respectively, of a bolt which can be incorporated with a connector in accordance with the present invention.
Figure 9A:
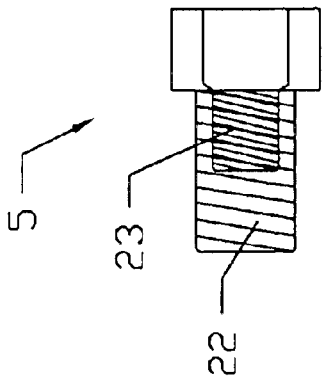
Figure 9D:
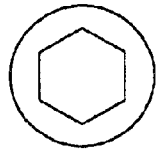
FIGS. 9C and 9D show a side view and end view, respectively, of a second bolt which can thread into the bolt shown in FIGS. 7A and 7B in accordance with the present invention.
Figure 9C:
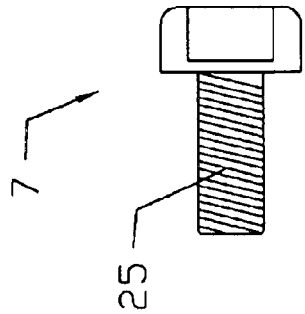
Figure 8:
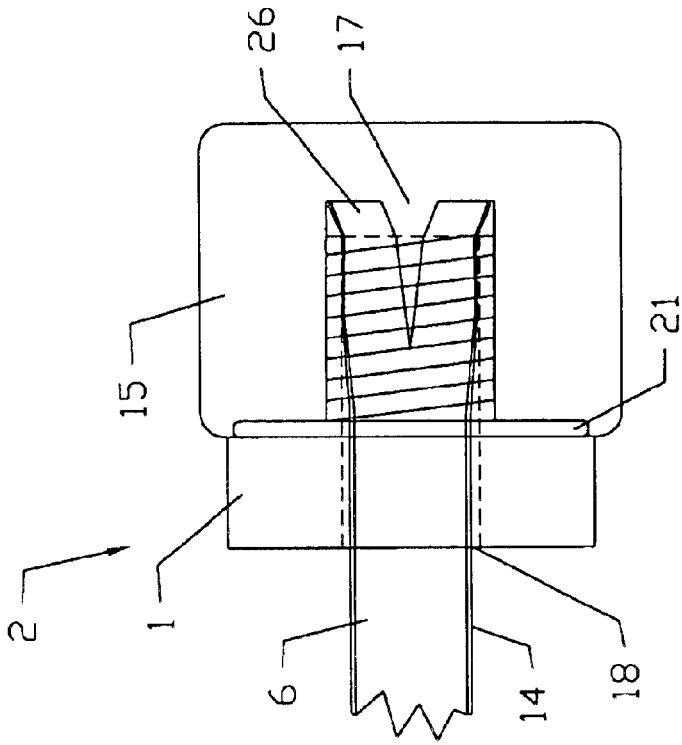
FIG. 8 is a sectional view of a connector of the present invention connected to a battery cable.

Referring to FIG. 1, an electrical connector 10 is illustrated having a battery terminal attaching portion 13 with an opening 3 which slips over the post of a battery terminal (not shown). The battery terminal attaching portion can then be pressed together so as to secure the connector 10 to a battery post. The connector 10 can generally be made of an electrically conductive material, such as brass. The electrical connector 10 shown in FIG. 1 further comprises a cable-receiving portion 15 having a bore 16 with internal threads 19 and a conductive prong 17 attached to, or integral with, the connector 10 and extending axially into the bore 16. In a specific embodiment, prong 17 can be threaded into a back wall 26 of bore 16. The conductive prong 17 can have a variety of shapes to enhance the functioning of the subject invention. In a specific embodiment, base 8 of prong 17 can have a first slope and tip 9 of prong 17 can have a second slope, where tip 9 can pierce the multi-stranded conductor 6 of a cable 12 and base 8 can force the end of the cable 12 to spread toward the inner wall of the bore 16. The cable 12 can have an insulation layer 14 over a multi-stranded conductor 6. The values of the first and second slopes and lengths of base 8 and tip 9 can be selected to optimize the subject invention.

FIGS. 2A–2D show examples of a cable receiving portion 15 and connector 10. In a specific embodiment, connector 10 can include a 0.1 MAX. RAD. type prong 17 and 9/16-18 UNF 2B type internal threading 19, with scaled dimensional units shown in FIGS. 2A–2D indicating the relative lengths of various sections and components of this specific embodiment. The cable receiving portion 15 can receive end cap 2 having external threads 4, a hex head 1, and an opening 18 sized to receive a multi-stranded cable 12 therethrough. FIGS. 3A–3D shows two examples of end caps 2 in accordance with the present invention. The two specific examples shown in FIGS. 3A–3D can be used with types #2 and #4 AWG wires, where both end caps shown having type 9/16-18 UNF 2A external threading 4. In a specific embodiment, a single connector 10 can be utilized for various size multi-stranded cables by utilizing an appropriate sized end cap with, for example, different thicknesses for the sidewalls of endcap 2.

In operation, cable 12 can be inserted through opening 18 of end cap 2, and into bore 16 where cable 12 is impaled on conductive prong 17 so that conductive prong 17 penetrates the end of multi-stranded conductor 6 of cable 12. Preferably, conductive prong 17 enters approximately near the center of the cross section of conductor 6. Cable 12 should be pushed on prong 17 until the end of cable 12 expands to have an outer diameter larger than the inner diameter of end cap 2. As outer threads 4 of end cap 2 are threaded into the inner threads 19 of bore 16, conductor 6 and outer insulation 14 are pressed onto prong 17. As end cap 2 is further threaded into cable receiving portion 15, its leading circular edge 27 further tightens outer insulation 14 and the strands of conductor 6 against prong 17, and possibly against the back wall 26 of bore 16. In this way cable 12 is mechanically secured in cable receiving portion 15 and electrically connected to connector 10. Preferably, a watertight seal is formed between the conductor's insulation 14 and end cap 2. Optionally, an o-ring 21 can be placed between end cap 2 and cable receiving portion 15 in order to create a watertight seal between end cap 2 and cable receiving portion 15.

Figure 12:
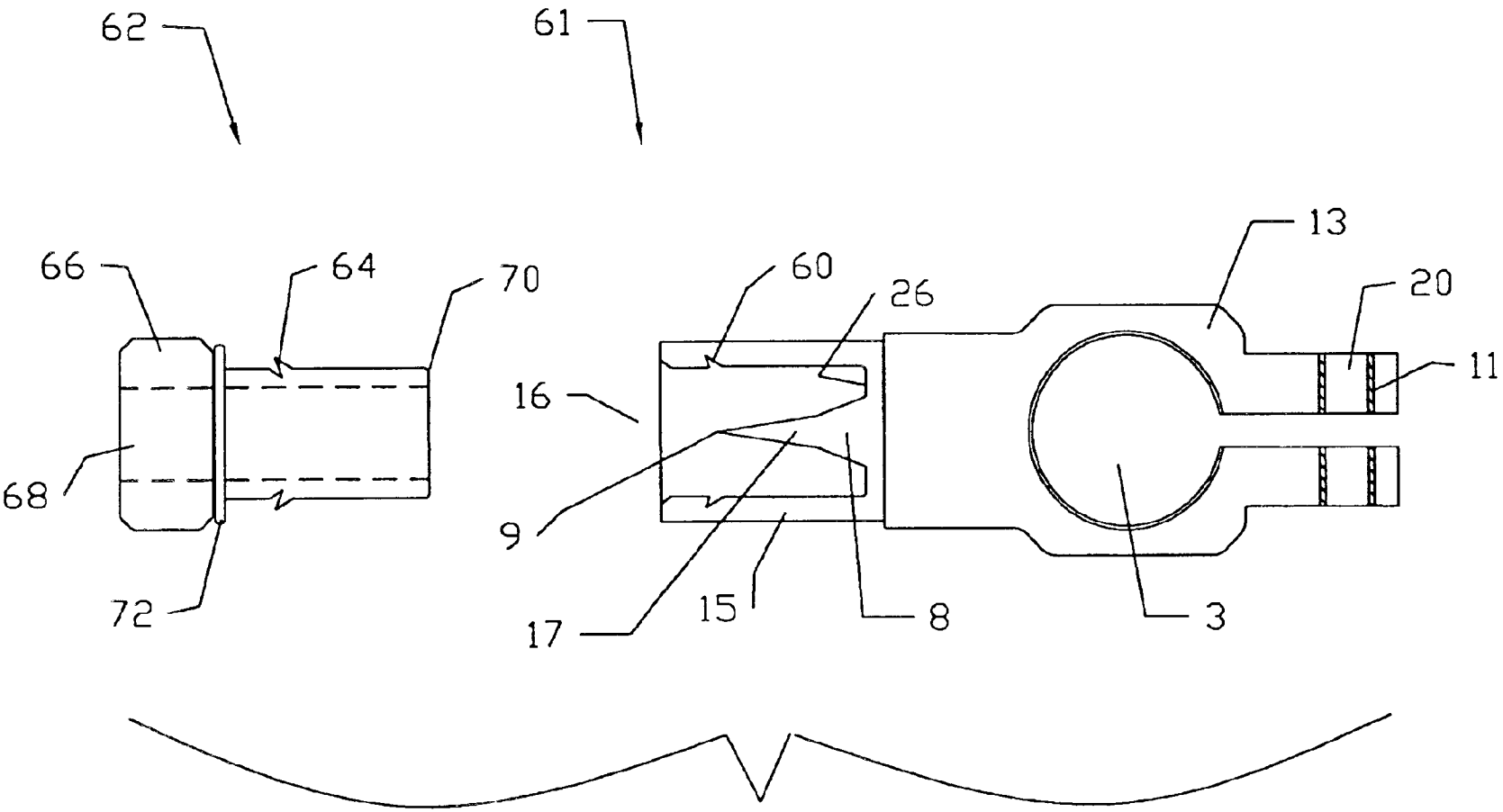
FIG. 12 is a sectional view of a connector in accordance with the present invention.

In order to allow for connection of additional conductors to the battery terminal without necessitating the removal or loosening of connector 10 from the battery terminal, the connector 10 can incorporate a bolt which receives another bolt for squeezing battery terminal portion onto a battery terminal post. First bolt 5 can have outer threads 22 for threading into the connector's housing. The connector 10 has a bore 20 with threads 11 that mate with the outer thread 22 of first screw 5 as it is threaded into the bore 20. Note that bore 20 can be placed on either the same side of opening 3 as cable receiving portion 15, as shown in FIG. 1, or on the opposite side of opening 3 as cable receiving portion 15, as shown in FIG. 12. Referring to FIGS. 9A–9D, first bolt 5 can also have a hollow portion 24 having inner threads 23 for receiving a second bolt 7 with outer threads 25. After first bolt 5 is threaded into bore 20 to secure the connector to the battery terminal, second bolt 7 can be threaded into hollow portion 24 of first bolt 5. Prior to threading second bolt 7 into first bolt 5, one or more ring terminals can be placed onto second bolt 7 such that once second bolt 7 is securely threaded into first bolt 5 the ring terminal is securely attached to the subject connector.

Figure 10A:
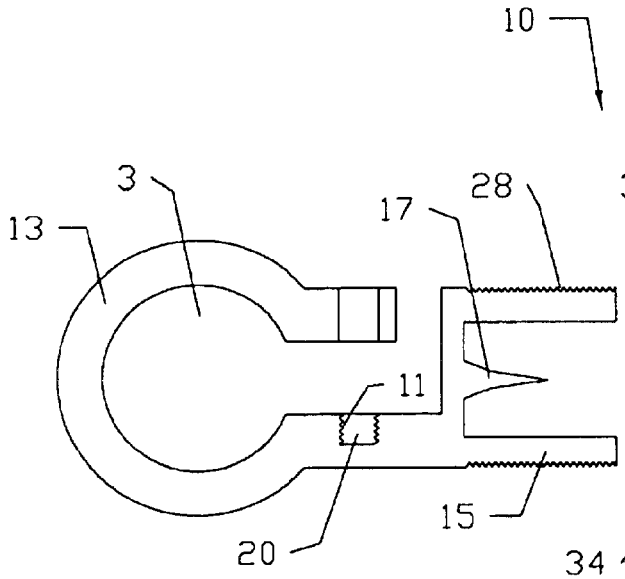
FIGS. 10A and 10B show a housing and end cap, respectively, of a connector in accordance with the subject invention.
Figure 10B:
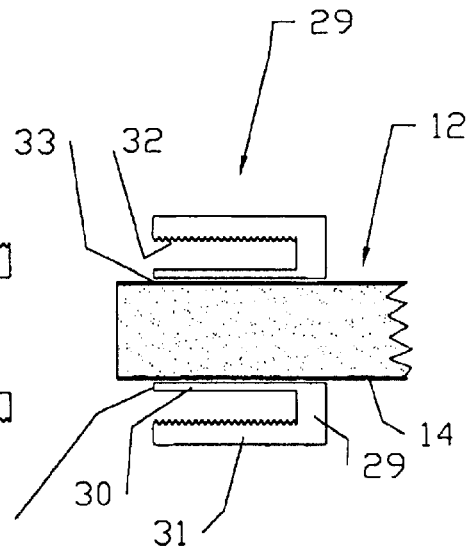

FIGS. 10A and 10B show another embodiment of the present invention where the cable receiving portion 15 receives end cap 29 having inner threads 32 on outer shell 31 of the end cap 29. End cap 29 has an inner tube 30 with end 34 and an opening 33 sized to receive a battery cable 12 therethrough. Cable 12 can have an insulated cover 14 over multi-stranded conductor 6. In operation, cable 12 is inserted through opening 33 of inner tube 30, and into bore 16 where it is driven upon conductive prong 17 so that the conductive prong penetrates the center conductor 6 of the cable 12. Preferably, conductive prong 17 penetrates at approximately the center of the center conductor 6 cross section. Preferably, center conductor 6 expands uniformly over the prong 17. As inner threads 32 of outer shell 31 are threaded onto the outer threads 28 of cable receiving portion 15, inner tube 30 enters bore 16 and presses outer insulation 14 and center conductor 6 toward conductive prong 17. After inner threads 32 of outer shell 31 have completely threaded onto outer threads 28 of cable-receiving portion 15, leading circular edge 34 of inner tube 30 presses into outer insulation 14 and presses center conductor 6 to prong 17 such that cable 12 is securely held to connector 10. Preferably, a watertight seal is formed between end cap 29 and cable 12. Optionally, an o-ring can be placed between end cap 29 and cable-receiving portion 15 in order to create a watertight seal between end cap 29 and cable-receiving portion 15.

Figure 11A:
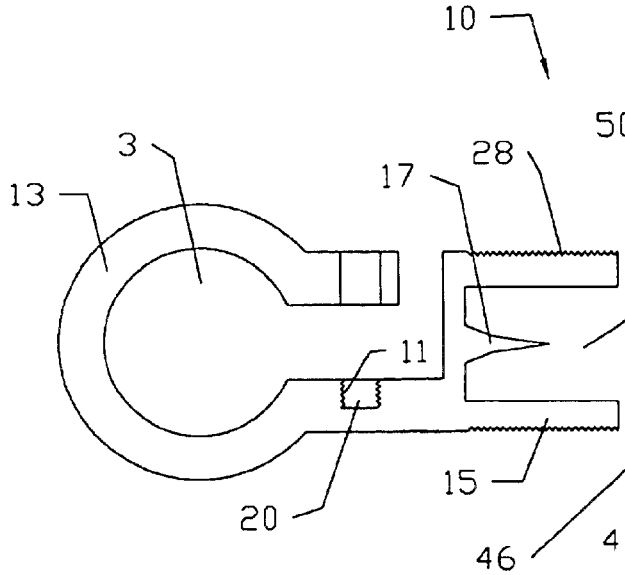
FIGS. 11A and 11B show a housing and end cap, respectively, of a connector in accordance with the subject invention.
Figure 11B:
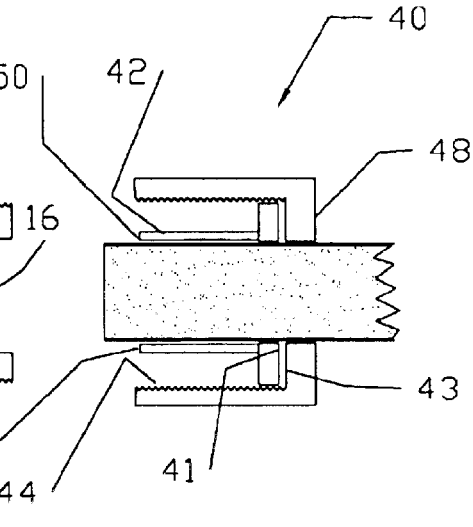

FIGS. 11A and 11B shows an embodiment of the present invention where the cable-receiving portion 15 receives end cap 40 with inner threads 44 and opening 48, and inner tube 42 with leading circular edge 46 and opening 50. Both openings 48 and 50 are sized to receive a battery cable 12 therethrough. In operation, cable 12 is inserted through openings 48 and 50, and into bore 16 where it is pushed upon electrically conductive prong 17 so that the conductive prong penetrates stranded conductor 6 of cable 12. Preferably, conductive prong 17 enters at approximately the center of the cross section of center conductor 6 and center conductor 6 expands uniformly over the prong 17. End cap 40 and inner tube 42 are free to rotate with respect to each other. As end cap 40 inner threads 44 are threaded onto outer threads 28 of cable-receiving portion 15, inside wall 43 of end cap 40 makes contact and begins to push on outside wall 41 of inner tube 42, pushing inner tube 42 further into bore 16. As cap 40 further tightens to connector 10 housing, leading circular edge 46 of inner tube 42 pushes into outer insulation 14 and presses outer insulation and center conductor 6 onto prong 17 such that cable 12 is secured to connector 10 and is in electrical contact with prong 17. Preferably, a watertight seal is formed between inner tube 42 and outer insulation 14. Optionally, an o-ring can be placed between inner tube 42 and cable-receiving portion 15 to form a watertight seal.

Referring again to FIGS. 11A and 11B, in a further embodiment of the present invention, inner tube 42 can be a plate having a plurality of tubes for receiving a corresponding plurality of cables 12. Cable receiving portion 15 can have a corresponding plurality of cables 12. Cable receiving portion 15 can have a corresponding plurality of bores 16 with a corresponding plurality of prongs 17, one prong 17 within each bore 16. End cap 40 with inner threads 44 can have a corresponding plurality of openings 48 for receiving the plurality of cables 12 therethrough. Each tube 42 can have a leading circular edge 46.

Figure 14A:
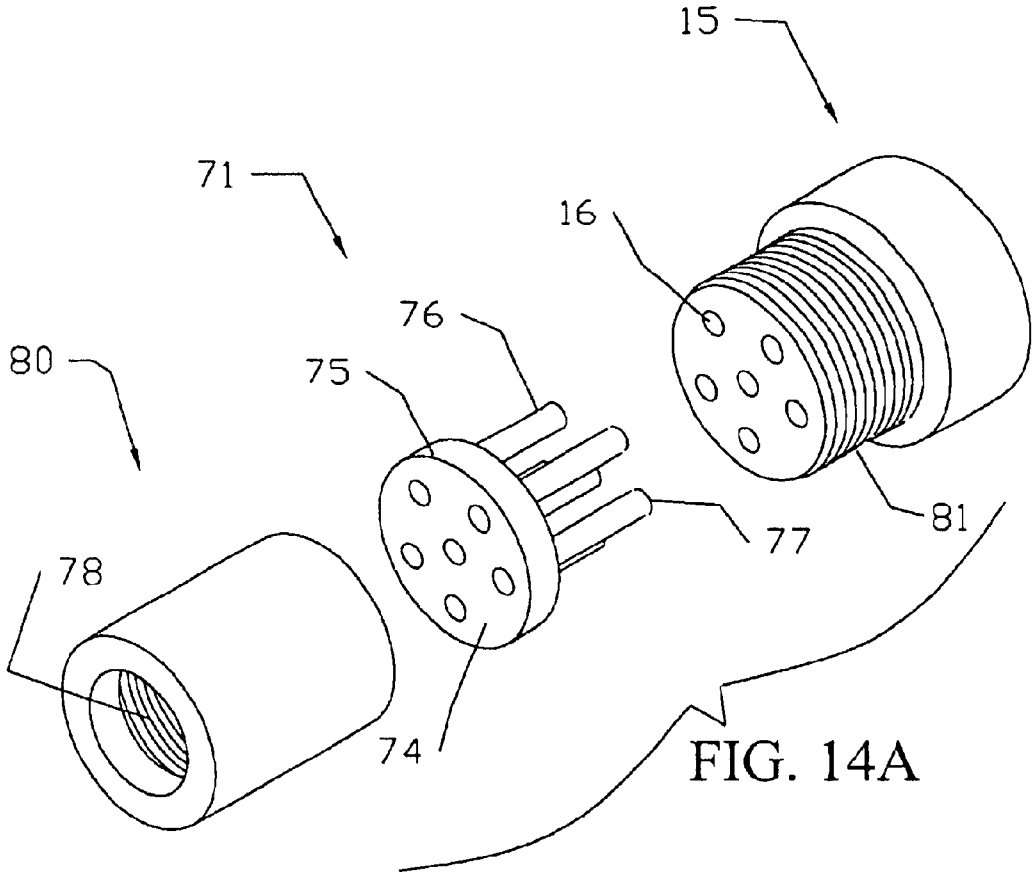
FIG. 14A shows a connector for a plurality of cables in accordance with the present invention.
Figure 14B:
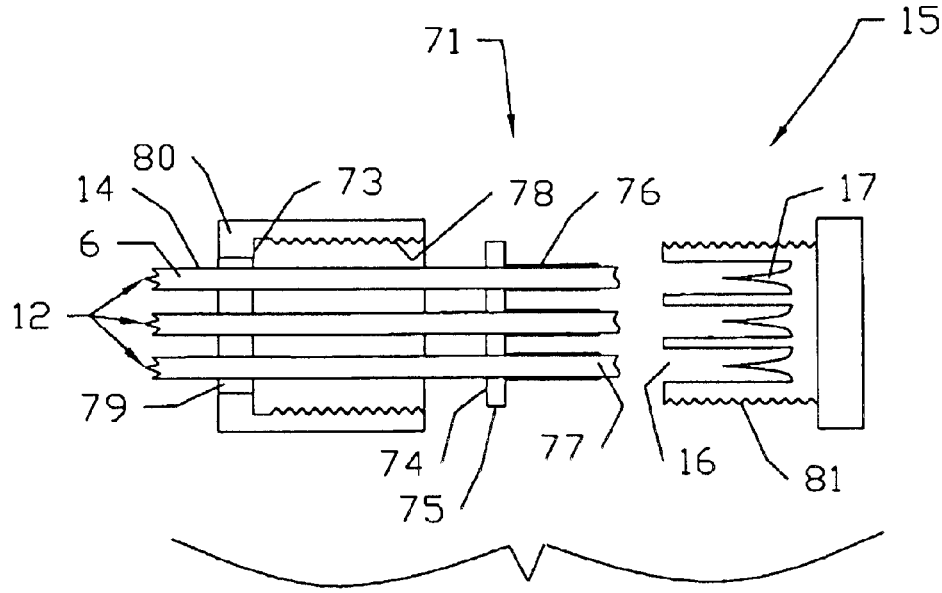
FIG. 14B is a sectional view of a connector for a plurality of cables in accordance with the present invention.

An example of such an embodiment is shown in FIGS. 14A and 14B. The specific embodiment shown in FIGS. 14A and 14B can have a plate 75 having a plurality of tubes 76 for receiving a corresponding plurality of cables 12, a cable receiving portion 15 with a corresponding plurality of bores 16 with a corresponding plurality of prongs 17, one prong 17 within each bore 16, and end cap 80 with inner threads 78 with an opening 79 for receiving the plurality of cables 12 therethrough. Each tube 76 can have a leading circular edge 77. In operation, each cable from the plurality of battery cables 12 is inserted through the opening 79 in end cap 80 and through an individual tube of the plurality of tubes 76. Each cable from the plurality of battery cables 12 then enters an individual bore 16 from the plurality of bores 16 and is driven upon an individual prong 17 from the plurality of electrical conductive prongs 17 so that each conductive prong 17 penetrates the center conductor 6 of the corresponding cable 12. Preferably, each conductive prong 17 penetrates approximately the center of the cross section of center conductor 6. Preferably, each stranded conductor 6 expands uniformly over each prong 17. Again, end cap 80 and the plate 75 having a plurality of inner tubes 76 are free to rotate with respect to each other. As the end cap 80 is threaded onto outer threads 81 of cable receiving portion 15, the inside lip 73 of end cap 80 makes contact and begins to push on the outside wall 74 of plate 75 causing the plurality of tubes 76 to each enter the corresponding bore 16 of the plurality of bores 16 and presses the stranded conductor 6 and outer insulation 14 of each cable 12 against corresponding prong 17. Further threading of end cap 80 onto cable receiving portion 15 presses each outer insulation 14 and center conductor 6 onto the corresponding prong 17 such that cable 12 is secured to connector 10 and is in electrical contact with prong 17 and, therefore, in electrical contact with connector 10. Preferably, a watertight seal is formed between each of the plurality of inner tubes 76 and outer insulation 14 of the corresponding cable 12. Optionally, a corresponding plurality of o-rings can be placed each between an inner tube 76 and cable-receiving portion 15 to form a watertight seal.

Specific embodiments of the subject invention tighten the cable's stranded conductor to each prong by threading a threaded cap onto the housing of the connector. In alternative embodiments other means can be utilized for securing the cable's stranded conductor to each prong. FIG. 12 illustrates a specific embodiment of the subject invention wherein electrical connector 10 is shown comprising a cable-receiving portion 15 having a bore 16 with an inner female clip-on profile 60 and a conductive prong 17 attached to, or integral with, the connector 10 and extending axially into the bore 16. The cable receiving portion 15 can receive end cap 62 having an outer male clip-on profile 64, hex head 66, and an opening 68 sized to receive a battery cable 12 therethrough. Preferably, the distance from leading edge 70 of end cap 62 to male clip-on profile 64 is slightly less than the distance from the back wall 26 of bore 16 to female clip-on profile 60. FIG. 12 shows bore 20 for receiving first bolt 5 on the opposite side of opening 3, rather than the near side of opening 3 in previous embodiments. The cable 12 can have an insulation layer 14 over a multi-stranded conductor 6.

In operation, cable 12 is inserted through opening 68 of end cap 62, and into bore 16 where cable 12 is impaled on conductive prong 17 so that conductive prong 17 penetrates the end of multi-stranded conductor 6 of cable 12. Preferably, conductive prong 17 enters approximately near the center of the cross section of conductor 6. As end cap 62 is pushed into said bore 16, and male clip-on profile 64 approaches female clip-on profile 60, conductor 6 and outer insulation 14 are pressed onto prong 17. Cable 12 should be pushed on prong 17 until the end of cable 12 expands to have an outer diameter larger than the inner diameter of end cap 62. When male clip-on profile 64 reaches female clip-on profile 60, said male clip-on profile 64 snaps into female clip-on profile 60 such that leading edge 70 of end cap 62 further tightens outer insulation 14 and the strands of conductor 6 against prong 17, and possibly against the back wall 26 of bore 16. In this way cable 12 is mechanically secured in cable receiving portion 15 and electrically connected to connector 10. Preferably, a watertight seal is formed between the conductor's insulation 14 and end cap 62. Optionally, an o-ring 72 can be placed between end cap 62 and cable receiving portion 15 in order to create a watertight seal between end cap 62 and cable receiving portion 15.

The subject invention can incorporate a clip-on profile so as to tighten the cable center conductor to each prong. In FIGS. 10A and 10B, instead of threading inner threads 32 of the outer shell 31 of end cap 29 through outer threads 28 of cable receiving portion 15, inner tube 30 can incorporate an outer male clip-on profile 64 and bore 16 of cable receiving portion can incorporate an inner female clip-on profile 70. As discussed in the paragraph above, after inner tube 30 has sufficiently progressed through bore 16 and male clip-on profile 64 reaches female clip-on profile 70, male clip-on profile 64 snaps into female clip-on profile 70, thus securing cable 6 to connector 10. Alternatively, outer shell 31 can incorporate an inner male clip-on profile 64 and cable receiving portion 15 can incorporate an outer female clip-on profile 70. After inner tube 30 has sufficiently progressed through bore 16 and male clip-on profile 64 reaches female clip-on profile 70, male clip-on profile 64 snaps down into female clip-on profile 70, thus securing cable 6 to connector 10.

In FIGS. 11A and 11B, instead of threading inner threads 44 of end cap 40 through outer threads 28 of cable receiving portion 15, end cap 40 can incorporate an inner male clip-on profile 64 and cable receiving portion 15 can incorporate an outer female clip-on profile 70. After inner tube 42 has sufficiently progressed through bore 16 and male clip-on profile 64 reaches female clip-on profile 70, male clip-on profile 64 snaps down into female clip-on profile 70, thus securing cable 6 to connector 10. Alternatively, inner tube 42 can incorporate an outer male clip-on profile 64 and bore 16 of cable receiving portion can incorporate an inner female clip-on profile 70. After inner tube 42 has sufficiently progressed through bore 16 and male clip-on profile 64 reaches female clip-on profile 70, male clip-on profile 64 snaps into female clip-on profile 70, thus securing cable 6 to connector 10. Note that end cap 40 is not required in the last mentioned embodiment.

In FIGS. 14A and 14B, instead of threading inner threads 78 of end cap 80 through outer threads 81 of cable receiving portion 15, each of the plurality of tubes of inner tube 76 can incorporate an outer male clip-on profile 64 and each bore 16 of cable receiving portion can incorporate an inner female clip-on profile 70. After each of the plurality of tubes of inner tube 76 has sufficiently progressed through each bore 16 and each male clip-on profile 64 reaches its corresponding female clip-on profile 70, male clip-on profile 64 snaps into female clip-on profile 60, thus securing each cable 6 to connector 10. In this embodiment end cap 80 is not required. Alternatively, the outer surface of cable receiving portion 15 can incorporate an outer male clip-on profile 64 and the inner surface of end cap 80 can incorporate a female clip-on profile 60.

Figure 13B:
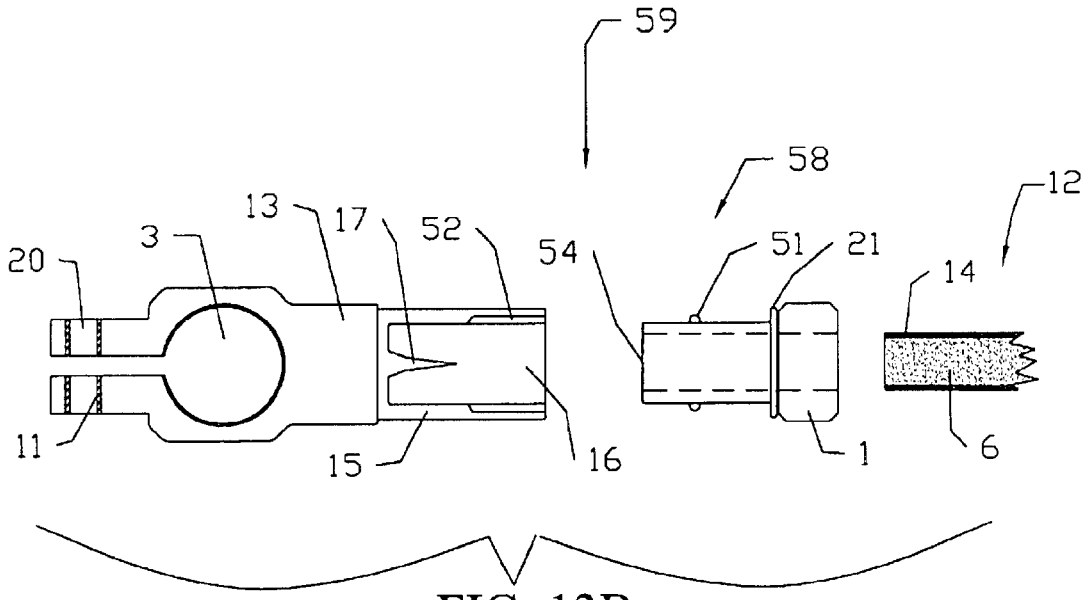
FIG. 13B shows a housing and end cap of a connector in accordance with the subject invention.
Figure 13B:
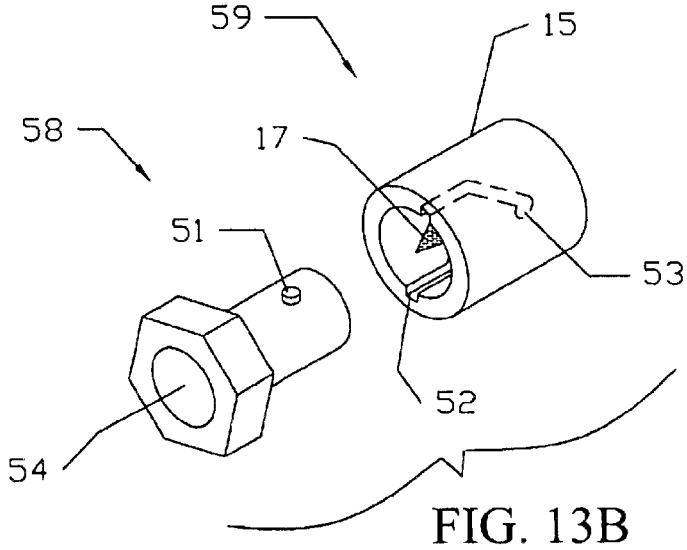

FIGS. 13A and 13B show an alternate embodiment of the present invention wherein cable-receiving portion 15 having a bore 16 with an inner accepting groove 52 and a conductive prong 17 attached to, or integral with, the connector 59 and extending axially into the bore 16 receives end cap 58 with outer engaging posts 51 and opening 54 sized to receive a battery cable 12 therethrough. The inner periphery of the bore 16 and the outer engaging periphery 51 of the end cap are cooperatively ridged and grooved in order to interlock in a longitudinal axial interference fit. This fit acts to mechanically secure the electrical conductor to the connector.

In operation, cable 12 is inserted through opening 54 and into bore 16 where it is pushed upon electrically conductive prong 17 so that the conductive prong penetrates conductor 6 of cable 12. As end cap 58 outer engaging posts 51 are radially inserted into an accepting groove 52 of cable receiving portion 15 and catches on an end notch 53, outer insulation 14 and center conductor 6 are pressed onto prong 17 such that cable 12 is secured to connector 59 and is in electrical contact with prong 17. Preferably, a watertight seal is formed between end cap 50 and the conductors insulation 14. Optionally, an o-ring 21 can be placed between end cap 50 and cable receiving portion 15 in order to create a watertight seal between end cap 50 and cable receiving portion 15.

The securing means shown in FIG. 13A and 13B can be incorporated with other embodiments of the subject invention as well. Referring to FIGS. 10A and 10B, instead of threading inner threads 32 of the outer shell 31 of end cap 29 onto outer threads 28 of cable receiving portion 15, inner tube 30 can incorporate an outer engaging periphery 51 and bore 16 of cable receiving portion can incorporate an inner accepting groove 52. After inner tube 30 has sufficiently progressed through bore 16 and outer engaging posts 51 are radially inserted into inner accepting groove 52, outer engaging posts 51 lock into an end notch 53 of the inner accepting groove 52, thus securing cable 6 to connector 10. Alternatively, outer shell 31 can incorporate inner engaging posts 51 and cable receiving portion 15 can incorporate an outer grooved accepting aperture 52. After inner tube 30 has sufficiently progressed through bore 16 and engaging posts 51 reach an end notch 53 of the accepting groove 52, engaging posts 51 lock into accepting aperture 52, thus securing cable 6 to connector 10.

Referring to FIGS. 14A and 14B, instead of threading inner threads 78 of end cap 80 onto outer threads 81 of cable receiving portion 15, the cable receiving portion 15 can incorporate outer engaging posts 51 and end cap 80 can incorporate an inner accepting groove 52. After each of the plurality of tubes of inner tube 76 has sufficiently progressed through each bore 16 and the engaging posts 51 are radially inserted into the inner accepting aperture 52 of the end cap 80, outer engaging posts 51 of cable receiving portion 15 lock into inner accepting aperture 52, thus securing each cable 6 to connector 71.

Figure 15:
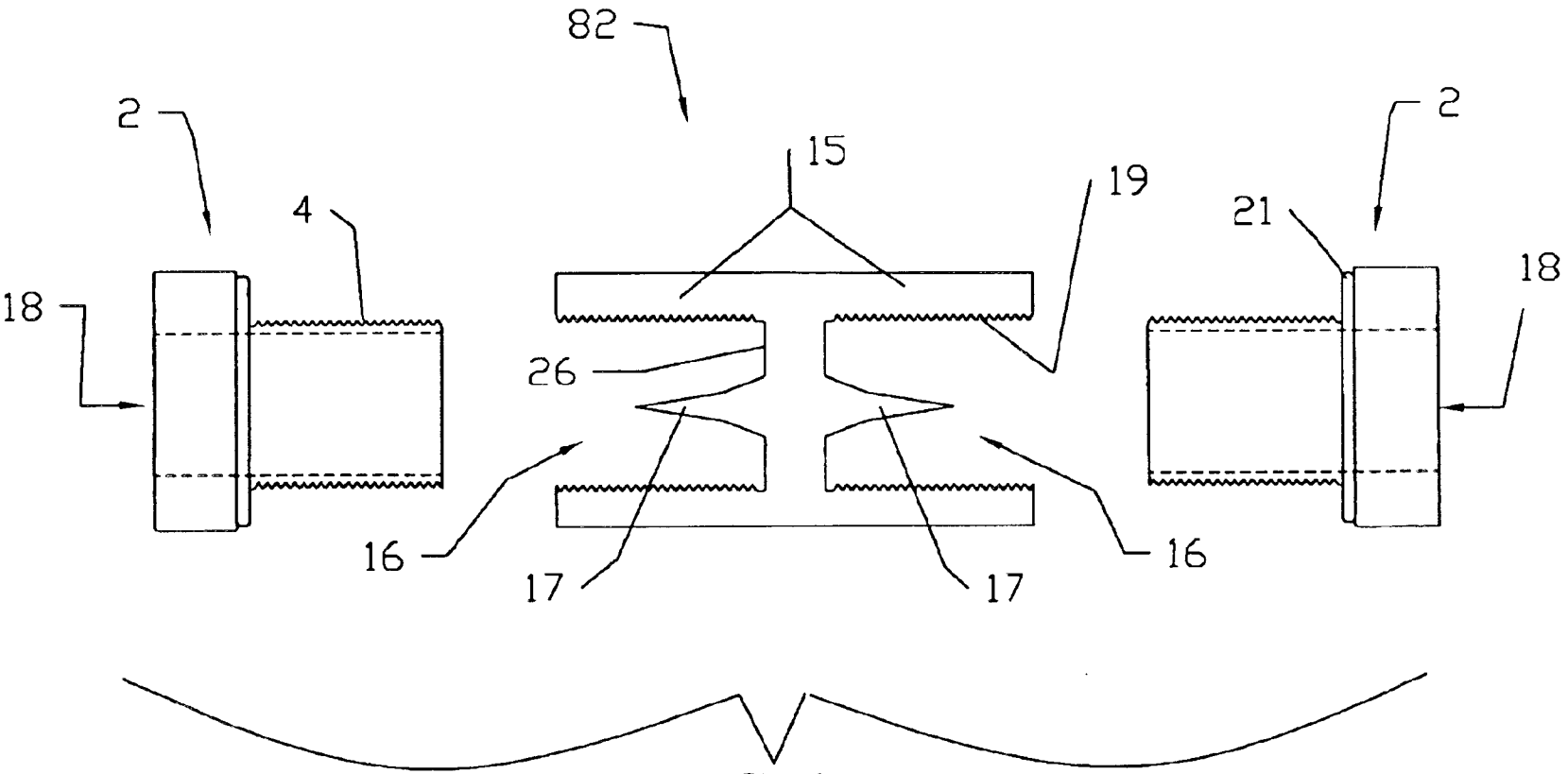
FIG. 15 is a sectional view of a splice connector in accordance with the present invention.

The subject connector can couple one or more conductive cables to one or more conductive cables. Once electrical contact is made between prong and conductor, a variety of designs can be used to enable the connection of connector 10 to other connectors or devices. A symmetric design can be utilized to connect a second cable 12 identical to the first cable 12 to form a splice connector. FIG. 15 illustrates one embodiment of a splice connector 82 in accordance with the subject invention. The cable receiving portion 15 receives two end caps 2 having outer threads 4 and an opening 18 sized to receive a cable therethrough. In operation, a cable 12 is inserted through the opening 18 where it is driven upon the tip of a conductive prong 17 and center conductor 6 expands uniformly over the prong 17 and possibly against the back wall 26 of bore 16. As each end cap 2 is further threaded into cable receiving portion 15, each cable 12 is mechanically secured and electrically connected together. Optionally an o-ring 21 can be place between end cap 2 and cable receiving portion 15 in order to create a watertight seal between end cap 2 and cable receiving portion 15. The subject splice connector can incorporate any of the other means for attaching and securing end cap 2 to cable receiving portion 15, as described throughout the application. For example, the cable receiving portion 15 of the subject splice connector can have threads 28 on the outside of the housing and the end caps 2 can take the form of either or both of the end caps 29 and 40 as seen in FIGS. 10B and 11B. As an alternate to threading as a means for tightening the cable center conductor to each prong, the end caps 2 can also incorporate a female clip-on profile 60 or a male clip-on profile 64 to correspond with a male clip-on profile 64 or a female clip-on profile 60, respectively. Engaging posts 51 and accepting apertures 52 can also be used as described in other embodiments.

With respect to terminology used in the subject application, the portion of the end cap 2, 29, 40, 62, 58, 76 which enters the bore 16 of the subject connector, namely the portion of end cap 2 with threads 4, inner tube 30, inner tube 42, the portion of the end cap 2 with outer male clip-on profile 64, the portion of end cap 58 with outer engaging periphery 51, and the plurality of inner tubes 76, respectively, can be referred to as a collar or tube. Accordingly, the securing means for engaging the housing can drive the collar or tube into the bore of the housing so as to press the strands of the multi-stranded conductor to the prong to make electrical contact between the prong and the multi-stranded conductor and secure the cable to the connector. The collar or tube can then be integral with the securing means or separate from the securing means, or can be considered as part of the securing means, whether integral with the end cap or separate from the end cap.

It should be understood that the examples and embodiments described herein are for illustrative purposes only and that various modifications or changes in light thereof will be suggested to persons skilled in the art and are to be included within the spirit and purview of this application and the scope of the appended claims.

All patents, patent applications, provisional applications, and publications referred to or cited herein are incorporated by reference in their entirety to the extent they are not inconsistent with the explicit teachings of this specification.

What is claimed is:

1. A connector for coupling to an insulated multi-stranded conductor cable, comprising:

a housing having at least one bore for receiving the cable, the bore having a back wall and an inner sidewall;

an electrically conductive prong extending from the back wall into the bore of the housing for impaling an end of the cable, the prong having a pointed tip, an expanded base on the back wall of the bore, and a sloped surface between the expanded base and the tip; and at least one hollow and substantially cylindrical tube having a leading edge, an outer surface of the tube being received by the inner sidewall of the bore and being advanceable into the bore, an inner surface of the tube sized to closely receive the insulated multi-stranded conductor cable the therethrough, the tube inner surface having a diameter;

wherein the end of the cable is inserted through and beyond the tube and an exposed end of the cable is impaled on the prong, advancement of the tube into the bore toward the back wall of the bare causing the leading edge of the tube, in cooperation with the sloped surface of the prong, to radially outwardly spread the insulation and strands of the cable beyond the diameter of the inner surface of the tube and toward the inner sidewall of the housing and clamp the exposed end of the cable between the leading edge and the sloped surface of the prong.

2. The connector of claim 1, wherein the prong is formed around an axis, said sloped surface being a surface of rotation around the axis with a first segment adjacent the back wall of the bore and a second segment adjacent the tip, the first and second segments having slopes relative to the axis which are different from each other.

3. The connector according to claim 2, wherein said first segment and said second segment are linear and meet at a point defining a change in slope.

4. The connector of claim 1, and further comprising securing means for securing the tube to the housing so as to mechanically fasten the cable to the connector.

5. The connector set forth in claim 4 wherein said tube and said securing means engage an exterior surface of the said housing.

6. The connector set forth in claim 5 wherein said securing means threadably engages the exterior surface of said housing.

7. The connector set forth in claim 4 wherein said securing means engages the interior surface of the bore in said housing.

8. The connector set forth in claim 4 wherein said tube and said securing means are integral.

9. The connector set forth in claim 4 wherein said securing means includes a projection from said tube mating with the housing at the interior surface of the bore.

10. The connector set forth in claim 4 wherein said securing means threadably engages the interior surface of the bore.

11. The connector according to claim 4, wherein the securing means comprises threads on the inner sidewall of the bore; and complimentary threads on the outer surface of the tube, wherein after insertion of the multi-stranded conductor cable into the bore and onto the electrically conductive prong, threading the tube into the bore presses the tube against the multi-stranded conductor so as to press the strands of the multi-stranded conductor cable against the prong so as to make electrical contact between the cable and the prong.

12. The connector according to claim 4, wherein the securing means comprises a female clip-on profile on the inner sidewall of the bore, and a male clip-on profile on the outer surface of the tube which is complimentary to the female clip-on profile of the bore of the housing, wherein after insertion of the multi-stranded conductor cable into the bore and onto the electrically conductive prong, pushing the tube into the bore presses the tube against the multi-stranded conductor cable so as to press the strands of the multi-stranded conductor cable against the prong so as to make electrical contact between the cable and the prong.

13. The connector according to claim 4, wherein the securing means comprises external threads on the housing and an outer tube coupled to the tube, wherein the outer tube comprises internal threads which are complimentary with the external threads on the housing, wherein after insertion of the multi-stranded conductor cable into the bore and onto the electrically conductive prong, threading the outer tube onto the threading on the housing drives the tube into the bore such that the tube presses against the multi-stranded conductor table so as to press the strands of the multi-stranded conductor cable against the prong so as to make electrical contact between the cable and the prong.

14. The connector according to claim 13, wherein the tube and outer tube are fixedly attached to each other.

15. The connector according to claim 13, wherein the outer tube comprises a lip having an inside wall which contacts an outside wall of a second lip of the tube so as to drive tube into the bore as the outer rube is threaded onto the threading of the housing.

16. The connector according to claim 4, wherein the securing means comprises an accepting groove on the inner sidewall of the bore and, an outer engaging post on the outer surface of the tube which is complimentary with the accepting groove of the bore, wherein after insertion of the multi-stranded conductor cable into the bore and onto the electrically conductive prong, guiding the outer engaging post of the tube into the accepting groove of the bore presses the tube against the multi-stranded conductor cable so to press the strands of the multi-stranded conductor cable against the prong so as to make electrical contact between the multi-stranded conductor cable and the prong.

17. The connector according to claim 4, wherein the housing has at least one additional bore for receiving at least one additional multi-stranded connector cable, and comprises a corresponding at least one additional electrically conductive prong each connected to the housing and positioned in a corresponding bore, wherein the securing means comprises a first inner tube and a corresponding at least one additional inner tube, and an outer tube, wherein the outer tube comprises internal threads complimentary with external threads on the housing, wherein after insertion of the multi-stranded conductor cable into the bore and the one or more of the at least one additional multi-stranded conductor cable, into the corresponding at least one additional bore, threading the outer tube onto the housing drives the first inner tube into the bore and the corresponding inner tube into the corresponding at least one additional bore so as to press the multi-stranded conductor cable against the prong and each of the at least one additional multi-stranded conductor cables against a corresponding at least one additional prong so as to make electrical contact between each of the cables and the respective prongs.

18. The connector of claim 1, wherein said at least one bore, tube and prong are respectively a first bore, first tube and first prong, the connector further comprising:

a second bore in said housing for receiving a second multi-stranded conductor cable;

an electrically conductive second prong connected to the housing and positioned in the second bore of the housing, wherein the second electrically conductive prong is electrically connected to the first prong;

a second hollow and substantially cylindrical tube, the second tube having a leading edge, an outer surface of the second tube received by an inner sidewall of the second bore and being advanceable into the second bore, an inner surface of the tube sized to closely receive the second cable therethrough, the inner surface of the second tube having a diameter;

wherein an end of the second cable is inserted through and beyond the second tube and the end of the second cable is impaled the second prong, advancement of the second tube within the second bore causing the leading edge of the second tube, in cooperation with the second prong, to radially outwardly spread the insulation and strands of the end of the second cable beyond the diameter of the inner surface of the second tube and toward the inner sidewall of the second bore, wherein the connector acts as a splice connector for the first and second multi-stranded connector cable.

19. The connector according to claim 1, wherein the electrically conductive prong is integral with the housing.

20. The connector according to claim 1, wherein the electrically conductive prong is threaded into the housing.

* * * * *